United States Patent [19]

Baruch

[11] Patent Number: 5,043,768

[45] Date of Patent: Aug. 27, 1991

[54] ROTATING WICK FOR FUSING APPARATUS

[75] Inventor: Susan C. Baruch, Fairport, N.Y.

[73] Assignee: Eastman Kodak Co., Rochester, N.Y.

[21] Appl. No.: 519,993

[22] Filed: May 7, 1990

[51] Int. Cl.[5] ..... G03G 15/20; G03G 21/00

[52] U.S. Cl. ..... 355/284; 355/282

[58] Field of Search ..... 355/284, 282, 283, 293, 355/295; 118/60, 256, 258, 262, 264, 266, 268

[56] References Cited

U.S. PATENT DOCUMENTS

| | | | |
|---|---|---|---|
| 3,964,431 | 6/1976 | Namiki | 118/60 |
| 4,375,201 | 3/1983 | Kato | 252/194 |
| 4,429,990 | 2/1984 | Tamary | 355/284 |
| 4,751,548 | 6/1988 | Lawson | 355/284 |
| 4,770,909 | 9/1988 | McIntyre | 118/262 X |
| 4,908,670 | 3/1990 | Ndebi | 355/284 |
| 4,942,433 | 7/1990 | Stuart | 355/282 X |

FOREIGN PATENT DOCUMENTS

| | | |
|---|---|---|
| 57-92683 | 5/1982 | Japan . |
| 60-86114 | 4/1985 | Japan . |
| 62-86212 | 4/1987 | Japan . |

*Primary Examiner*—R. L. Moses
*Assistant Examiner*—Sandra L. Hoffman
*Attorney, Agent, or Firm*—Leonard W. Treash, Jr.

[57] ABSTRACT

A rotating release liquid applying device for a fuser which fuses toner images on a receiving sheet, includes an outer porous ceramic material which contacts a surface to which liquid is to be applied and rotates with movement of that surface. Liquid is fed by a pump through a distribution tube located inside the ceramic material.

9 Claims, 2 Drawing Sheets

ROTATING WICK FOR FUSING APPARATUS

FIELD OF THE INVENTION

This invention relates to apparatus for fusing toner images carried on a sheet. More particularly, it relates to a rotating wick oiling device for applying offset preventing liquid to a surface of such a fuser.

BACKGROUND ART

U.S. Pat. No. 4,429,990, granted to E. J. Tamary, Feb. 7, 1984, discloses a wicking structure for applying release liquid to the surface of a roller in a roller fixing apparatus. Release liquid, commonly referred to as "oil", is transported under pressure from a container to a permanent internal feed tube located inside a replaceable porous applicating wick. The feed tube and wick constitute a wicking or application roller which, when in contact with the fixing roller, is rotated by the fixing roller while it "oils" the surface. The structure has many advantages including ease in articulation and low wear on the fixing roller's surface.

The structure shown in that patent is commonly called a "rotating wick" and has been adopted commercially in a number of copiers and printers. The release liquid is delivered to the rotating wick using a pump through an oil feed line to a rotatable feed tube. The feed tube is cylindrical and has small holes drilled or punched along its elongated sidewalls through which liquid can pass. A replaceable wick surrounds the feed tube. It is installed or pulled over the free end of the feed tube. The replaceable wick is a porous structure which includes an inner ceramic porous material that is covered by a porous and heat-resistant fabric such as wool or a comparable synthetic fabric. Such a synthetic fabric is marketed by DuPont under the trademark NOMEX and is a well known capillary fabric which is resistant to heat and used for a variety of fusing system wicks.

U.S. Pat. No. 4,908,670, issued Mar. 13, 1990, shows the structure in which a ceramic inner core from the Tamary structure has been eliminated by using a NOMEX wrap of one or two layers directly on the distribution tube. See also, U.S. Pat. No. 3,964,431 which also shows an internally fed structure, but in which the outer material is a soft porous material such as foamed silicone rubber.

The wool, NOMEX or other fabric wraps on virtually all prior commercial rotating wicks have worked well for many applications. However, for some applications, the fabric rolling with the fusing roller leaves the pattern of the fabric in the oil coating of the fusing roller. This can cause a pattern on the receiving sheet which is especially noticeable in transparencies. Low areas of oil can also cause insufficient release causing a pickup of toner by the fusing roller. This, of course, disturbs the toned image on the sheet and in time causes wear to the fusing roller.

STATEMENT OF THE INVENTION

It is the object of the invention to provide a device for applying offset preventing liquid to a surface of a fusing member which rolls with movement of the surface as in the prior art but which provides a more uniform laydown of liquid.

This and other objects are accomplished by a liquid applying device which has an elongated hollow distribution tube having a plurality of holes through which liquid under pressure can flow as in the prior art and a porous ceramic material surrounding the tube and having an outside ceramic surface rollable on the surface to be treated. The ceramic material has sufficiently fine pores to pass liquid from the distribution tube to the surface to be treated without localized areas of excessive liquid.

As mentioned above, a porous ceramic has been used between the distribution tube and a fiber outer coating (generally NOMEX) commercially for years. This invention was made when a commercial rotating wick was tried without the outer fiber coating with the ceramic rolling directly on the fusing surface. The ceramic had a porosity of approximately 40 microns. With that ceramic, a significant improvement in regularity of laydown was noted. However, after experimentation with other ceramics. It was found that finer porosities work even better with a porosity of approximately 10 microns being ideal.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
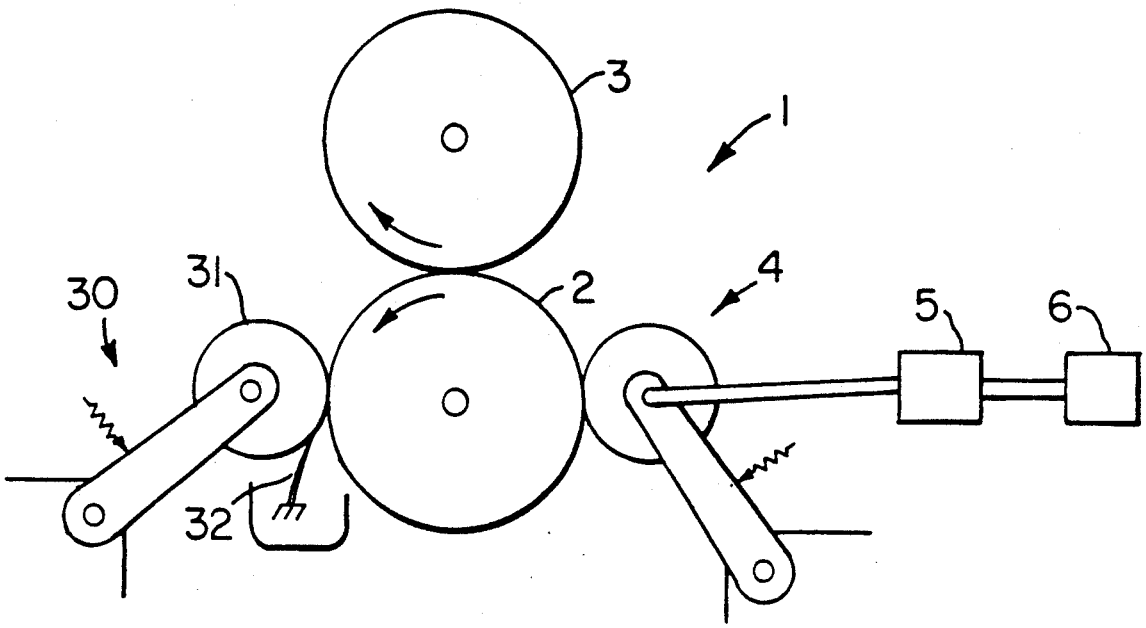
FIG. 1 is a side schematic of a fuser in which the invention is useful.

FIG. 1 shows a fuser 1 having a fusing roller 2 and a pressure roller 3 which are conventional for applying both heat and pressure to a toner image carried by a receiving sheet and fed into a nip between the rollers. The rollers are constantly rotated when in use. In order to prevent toner from offsetting onto the fusing roller 2, a small amount of silicone oil or other release liquid is applied to the moving surface of fusing roller 2. This is accomplished by a wicking or oiling device 4 which is movable in and out of engagement with fusing roller 2. Silicone oil is fed from a reservoir 6 by a pump 5 to an internal feed tube for oiling device 4 which is better shown in the other Figs. To control the amount of oil applied, it has been customary to program the movement of the wicking device into and out of contact with the fusing roller 2. That program can be varied according to the need for oil between the beginning and the end of a run and between paper receiving sheets and transparencies.

However, prior oiling devices of this type which roll with the surface to which the oil is to be applied have a tendency to leave an imprint in the oil from the wicking device. Since these prior wicking devices generally include a fiber-like material such as wool or NOMEX as the material contacting the surface to be oiled, a fairly coarse fiber imprint is left on the fusing roll. This causes spots on the final copy which are noticeable, especially with transparencies. Some areas in the pattern leave such little oil that toner offsets to those areas. Such offset materially affects the life of the fusing roller itself and the quality of the image from which the toner offset (as well as the image onto which it may subsequently transfer).

In attempting to cure this problem, a prior art rotating wicking roller having a distribution tube, a porous ceramic material surrounding the tube and spaced from it and a NOMEX outer covering was tried without the NOMEX outer covering. This provided significant improvement in the regularity of oil laydown. The ceramic in question had a porosity of approximately 40 microns. However, with further experimentation, it was found that finer porosity, for example, about 10 microns gave even better results, virtually eliminating visible irregularities in oil laydown.

Figure 2:
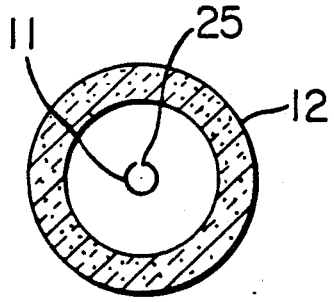
FIG. 2 is a cross-section of a wicking device constructed according to the invention.
Figure 3:
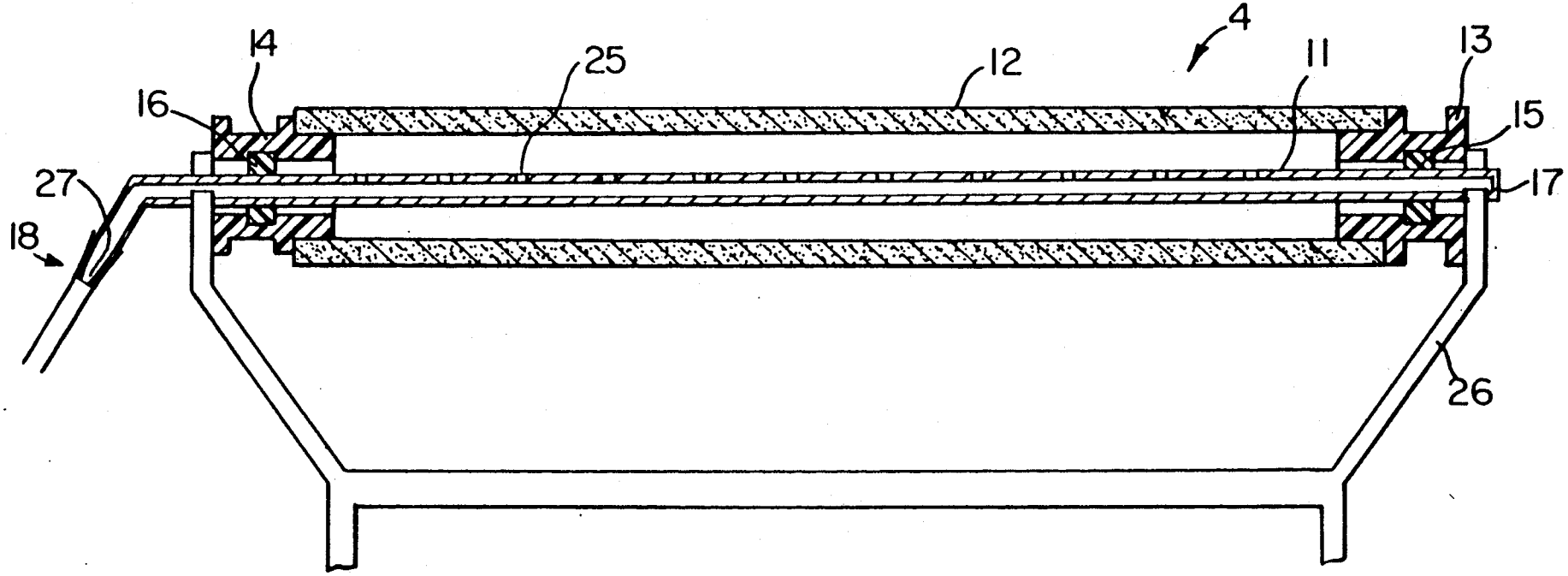
FIG. 3 is a side view of a wicking device constructed according to the invention with end and support structure shown that are not shown in FIG. 2.

FIGS. 2 and 3 illustrate an oiling device constructed according to the invention. According to FIG. 3 an elongated distribution tube 11 has a plurality of small diameter holes 25. The distribution tube is held fixed in a wick holding device 26 which is spring urged against the fusing roller 2 when in its operative position (FIG. 1). The distribution tube has a closed end 17 and an open end 27 which open end is connectable to a feed line at a coupling 18. The feed line runs to oil reservoir 6 through pump 5 (FIG. 1).

A porous ceramic material 12 surrounds the distribution tube 11. It is supported by end members 13 and 14 which include plastic bearings 15 and 16 which permit the ceramic material 12 and the end members 13 and 14 to rotate with respect to distribution tube 11.

Prior rotating wick structures generally combine the wick and the feed tube. The feed tube rotates with the wick. However, the structure shown in FIG. 3 allows the wick to rotate with respect to the feed tube which permits the holes 25 in the feed tube 11 to be always positioned in a generally upward direction. This reduces a tendency of oil to escape from the holes when the pump is not on and the wick is stationary, thereby preventing localized wetting of one portion of the ceramic material 12. This is especially helpful when using lower viscosity release oils.

The pores of ceramic material 12 are somewhat more likely to become clogged with toner when they are not covered by the fiber covering common in the prior art. Accordingly, a fusing roller cleaning device 30 is provided which is of the rotating roller type and includes a rotating roller 30 having a surface to which toner has a tendency to adhere. Examples of such cleaners are shown in U.S. Pat. Nos. 3,868,744 and 3,980,424. The surface of roller 31 is metal or metal oxide and remains covered with toner or materials similar to toner to which the toner readily adheres in a hot and tacky state. (The surface of roller 31 may also be kept clean by a cleaning blade 32.)

Replacement of the oiling device in the copier is accomplished by separating the distribution tube at coupling 18, lifting the distribution tube off its support 26 and then separating the distribution tube from the spacers 13 and 14 by pulling the distribution tube out through spacer 14. The distribution tube can be reused with a new ceramic material by merely placing the new ceramic material with its spacers 13 and 14 back over the end of distribution tube 11 and reconnecting the distribution tube to coupling 18 then also to support 26. However, we have found that replacing the distribution tube at the same time that the ceramic 12 needs replacing contributes to good preventive maintenance. Accordingly, the distribution tube can be inserted in the spacers 13 and 14 in the factory and replaced as a single item.

The ceramic material 12 which has been used under a covering of NOMEX in prior wicking rollers is typical of porous ceramics used in the water purification industry. Such ceramics are generally made of a high concentration of silicon dioxide or aluminum oxide in a binder and with other small traces of materials. The concentrations of these materials vary according to the source of the starting material for the ceramic. A typical porous ceramic material which was used successfully in my device is approximately 80 percent aluminum oxide, 10 percent silicon dioxide and 10 percent of other materials and was purchased as an off-the-shelf item from a supplier of such materials.

Although we have found that porosity of 10 microns works best and the porosities as high as 40 microns given beneficial results, porosities outside this range may be found useful in some applications.

The invention has been described in detail with particular reference to preferred embodiments thereof, but it will be understood that variations and modifications can be effected within the spirit and scope of the invention.

I claim:

1. A fuser, including a fusing member having a movable surface and a device for applying oil to said surface, said device including:

an elongated hollow distribution tube having a plurality of holes through which oil under pressure can flow, and a porous ceramic material surrounding said tube said ceramic material having an outside surface rollable on the surface to be oiled, said ceramic material having sufficiently fine pores to pass oil from said distribution tube to said surface to be oiled without localized areas of excess oil.

2. A fuser according to claim 1, including a pump for pumping oil to the interior of said distribution tube.

3. A fuser according to claim 1, wherein said porous ceramic material is generally cylindrical in shape and is spaced from said distribution tube.

4. A fuser according to claim 3, wherein said ceramic material is spaced from said distribution tube by a pair of spacing elements located at each end of said material each of which spacing elements include an opening for said distribution tube and a bearing surface permitting rotation of said ceramic material with respect to said distribution tube.

5. A fuser according to claim 4, wherein the plurality of holes through said distribution tube are located in a generally upward direction to lessen the escape of oil from said tube when said oil is not under pressure.

6. A rotatable oil applying device for insertion in a rotating wick oil applying apparatus for a fuser, said oil applying device comprising:

an uncovered hollow porous ceramic material and a pair of end spacers in each end of said material, said spacers having holes in their center for receipt of a distribution tube and bearing surfaces permitting rotation of said spacers and said ceramic material with respect to said distribution tube.

7. The oil applying device according to claim 6, wherein said ceramic material has a porosity of 40 microns or less.

8. A rotatable oil applying device for insertion in a rotating wick oil applying apparatus for a fuser, said device including an uncovered hollow porous ceramic material and a pair of end spacers, one of said end spacers having a hole through which oil is deliverable to the hollow interior of said ceramic material.

9. The device according to claim 8 wherein said end spacers include means for supporting said device for rotation.

* * * * *